United States Patent [19]

Ishikawa et al.

[11] Patent Number: 4,886,259

[45] Date of Patent: Dec. 12, 1989

[54] SORTER-FINISHER SYSTEM

[75] Inventors: Takuma Ishikawa; Kuniaki Ishiguro, both of Toyokawa, Japan

[73] Assignee: Minolta Camera Kabushiki Kaisha, Osaka, Japan

[21] Appl. No.: 78,753

[22] Filed: Jul. 28, 1987

[30] Foreign Application Priority Data

| | | | |
|---|---|---|---|
| Aug. 2, 1986 | [JP] | Japan | 61-182469 |
| Aug. 2, 1986 | [JP] | Japan | 61-182470 |
| Aug. 2, 1986 | [JP] | Japan | 61-182471 |
| Aug. 2, 1986 | [JP] | Japan | 61-182472 |

[51] Int. Cl.[4] ..... B42B 1/02

[52] U.S. Cl. ..... 270/53; 270/58

[58] Field of Search ..... 270/53, 37, 58; 271/290, 292, 293, 294, 207, 209; 355/3 SH, 14 SH; 206/564, 557, 562

[56] References Cited

U.S. PATENT DOCUMENTS

| | | | |
|---|---|---|---|
| 3,386,729 | 6/1968 | Pine | 270/52.5 |
| 3,645,615 | 2/1972 | Spear, Jr. | 355/3 |
| 3,697,063 | 10/1972 | Greenfield et al. | 271/4 |
| 3,709,595 | 1/1973 | Turner et al. | 355/14 |
| 3,944,207 | 3/1976 | Bains | 270/58 |
| 3,945,728 | 3/1976 | Crandell | 355/75 |
| 4,067,649 | 1/1978 | Hubbard et al. | 355/14 |
| 4,073,391 | 12/1978 | O'Brien et al. | 214/65 |
| 4,076,408 | 2/1978 | Reid et al. | 355/14 |
| 4,123,155 | 10/1978 | Hubert | 355/26 |
| 4,134,672 | 1/1979 | Burlew et al. | 355/14 |
| 4,145,037 | 3/1979 | Mol | 271/294 |
| 4,190,246 | 2/1980 | Sasuga | 271/145 |
| 4,203,587 | 5/1980 | Kishi et al. | 271/293 |
| 4,218,128 | 8/1980 | Satomi et al. | 355/14 SH |
| 4,227,275 | 10/1980 | Söderberg | 270/37 |
| 4,238,066 | 12/1980 | Brooke | 227/39 |
| 4,248,413 | 2/1981 | Fox | 270/53 |
| 4,248,525 | 2/1981 | Sterrett | 355/14 SH |
| 4,265,440 | 5/1981 | Shibazaki et al. | 271/9 |
| 4,272,180 | 6/1981 | Satomi et al. | 355/3 SH |
| 4,281,920 | 8/1981 | Cross | 355/75 |

(List continued on next page.)

FOREIGN PATENT DOCUMENTS

| | | | |
|---|---|---|---|
| 99250 | 1/1984 | European Pat. Off. . | |
| 2732673 | 9/1978 | Fed. Rep. of Germany . | |
| 3701450 | 7/1987 | Fed. Rep. of Germany . | |
| 3743989 | 9/1987 | Fed. Rep. of Germany . | |
| 55-15150 | 2/1980 | Japan . | |
| 55-111956 | 8/1980 | Japan . | |
| 72537 | 5/1982 | Japan . | |
| 57-72537 | 5/1982 | Japan . | |
| 131667 | 8/1982 | Japan | 270/58 |
| 57-203037 | 12/1982 | Japan . | |
| 59-43765 | 3/1984 | Japan . | |
| 59-177232 | 10/1984 | Japan . | |
| 60-22127 | 2/1985 | Japan . | |
| 60-150061 | 8/1985 | Japan . | |
| 60-183461 | 9/1985 | Japan . | |

(List continued on next page.)

OTHER PUBLICATIONS

IBM Technical Bulletin, vol. 18, No. 9, 2/76.
Xerox Disclosure Journal, vol. 2, No. 5, Sep./Oct. 1977.

*Primary Examiner*—Robert E. Garrett
*Assistant Examiner*—Therese M. Newholm
*Attorney, Agent, or Firm*—Burns, Doane, Swecker & Mathis

[57] ABSTRACT

A sorter-finisher system having a sorting unit comprising plural number of inclined bins arranged vertically at specified intervals and a transport unit for transporting bunches of sheets distributed among the bins to a sheet binding unit. When the sheets have been distributed among the bins, the bins move to a sheet receiving opening of the transport unit one by one. The bunches of the sheets in the bins are transported to the binding unit through the sheet receiving opening for binding. The angle of inclination of each bin at the position opposite to said sheet receiving opening is set larger than that of the bin at the position for the distribution of the sheets. In order to shift each bin from the position for the distribution of the sheets to the position where the sheet receiving opening is located, for example, a cam with a spiral groove designed to engage with a trunnion provided to each of the bins is used.

14 Claims, 11 Drawing Sheets

U.S. PATENT DOCUMENTS

| | | | |
|---|---|---|---|
| 4,295,733 | 10/1981 | Janssen et al. | 355/14 SH |
| 4,313,670 | 2/1982 | Caldwell | 355/3 R |
| 4,361,393 | 11/1982 | Noto | 355/14 SH |
| 4,365,886 | 12/1982 | Murakami et al. | 355/3 SH |
| 4,368,972 | 1/1983 | Naramore | 355/14 SH |
| 4,371,155 | 2/1983 | Astero et al. | 270/53 |
| 4,376,529 | 3/1983 | George et al. | 270/53 |
| 4,385,827 | 5/1983 | Naramore | 355/14 SH |
| 4,411,515 | 10/1983 | Kukucka et al. | 355/14 SH |
| 4,424,963 | 1/1984 | Bartholet et al. | 270/53 |
| 4,473,425 | 9/1984 | Baughman et al. | 156/356 |
| 4,497,478 | 2/1985 | Reschenhofer et al. | 270/53 |
| 4,515,458 | 5/1985 | Masuda et al. | 355/3 SH |
| 4,549,804 | 10/1985 | Braun et al. | 355/14 SH |
| 4,564,185 | 1/1986 | Hamlin et al. | 270/53 |
| 4,566,782 | 1/1986 | Britt et al. | 355/14 SH |
| 4,573,789 | 3/1986 | Wada | 355/14 SH |
| 4,582,421 | 4/1986 | Hamlin et al. | 355/72 |
| 4,592,651 | 6/1986 | Oikawa et al. | 355/72 |
| 4,595,187 | 6/1986 | Bober | 270/37 |
| 4,603,971 | 8/1986 | Kukucka et al. | 355/133 |
| 4,620,782 | 11/1986 | Kurando et al. | 355/14 SH |
| 4,626,156 | 12/1986 | Baughman et al. | 412/33 |
| 4,647,034 | 3/1987 | Sawa | 271/293 |
| 4,647,188 | 3/1987 | Komiya et al. | 355/55 |
| 4,674,732 | 6/1987 | Hori | 270/53 |
| 4,674,862 | 6/1987 | Abuyama | 355/14 SH |
| 4,674,866 | 6/1987 | Tanaka | 355/23 |
| 4,687,191 | 8/1987 | Stemmle | 271/193 |
| 4,702,589 | 10/1987 | Ito | 355/14 SH |
| 4,718,657 | 1/1988 | Otter et al. | 271/184 |
| 4,721,382 | 1/1988 | Ito et al. | 355/14 SH |
| 4,730,204 | 3/1988 | Satoh et al. | 355/14 SH |
| 4,730,206 | 3/1988 | Sawada et al. | 355/3 H |
| 4,763,889 | 8/1988 | Dei et al. | 271/9 |

FOREIGN PATENT DOCUMENTS

| | | | |
|---|---|---|---|
| 60-284563 | 12/1985 | Japan . | |
| 61-72569 | 4/1986 | Japan . | |
| 61-95363(A) | 5/1986 | Japan . | |
| 61-26061 | 6/1986 | Japan . | |
| 145069 | 7/1986 | Japan | 271/293 |
| 61-204626 | 9/1986 | Japan . | |
| 61-238041 | 10/1986 | Japan . | |
| 61-261096 | 11/1986 | Japan . | |
| 62-9367 | 1/1987 | Japan . | |
| 2185465 | 7/1987 | United Kingdom . | |

SORTER-FINISHER SYSTEM

BACKGROUND OF THE INVENTION

1. Field of the Invention

The present invention relates to a sorter-finisher system, more particularly, comprising a sheet distributor and sheet binder so that the sheets carrying the images transcribed by the copying machine can be distributed and bound accordingly after being ejected from the copying machine.

2. Description of the Related Art

Recently, responding to the increasing demand for automated paper handling systems for copying machines, optional systems such as automatic document feeding system and sorting systems designed for sorting or grouping the duplicate sheets have been developed and commercialized in various types. The users of the copying machines are now requiring the sorter-finisher system capable of automatically binding and stacking the duplicate sheets which have been distributed and stocked in the sorting system, and this type sorter-finisher system has already been commercialized for some of large-sized copying machines.

For example, those publicized in U.S. Pat. No. 4,549,804, issued Oct. 29, 1985 to Braun et al., U.S. Pat. No. 4,248,525, issued Feb. 3, 1981 to Sterret, U.S. Pat. No. 4,361,393, issued Nov. 30, 1982 to Noto, are known as the sorter-finisher system falling under said category. However, all such sorter-finisher systems have their finishers designed for the installation on the side of the sorter. Besides, such sorter-finisher systems are not applicable to the small-sized copying machines designed for the general users, because even the sorter alone is too large both in size and installation. Especially, the kind of system wherein the sheets distributed among and stocked in the bins have to be taken out by an oscillating arm with a sheet holder and transferred to a binder by the feeder is not only too complex mechanically but also too large in size.

SUMMARY OF THE INVENTION

An object of the present invention is to provided a sorter-finisher system having a more compact and simpler binding unit and transport unit capable of transporting the bunches of sheets to the binding unit from the bins of the sorting unit.

Another object of the present invention is to provide a mechanism for smoothly transporting the bunches of sheets distributed among the bins of the sorting unit to the transport unit leading to the binding unit.

A further object of the present invention is to provide a binding apparatus for preventing the stock capacity from being affected by the height of the bunches of bound sheets which varies depending on how much the thickness of each bunch is affected by being bound when the bunches are finally placed on the stack tray.

Thus, the sorter-finisher system relating to the present invention has plurality of bins with inclined sheet loading surfaces arranged vertically at specified intervals, a distributor for distributing the sheets among said plurality of bins, a binding unit for binding the bunches of sheets, a bunched sheets transport unit with a sheet receiving opening located below said plural number of bins so that the sheets received through said receiving opening can be transported to said binding unit and a mechanism for enabling said plurality of bins to be shifted one by one to the position opposite said receiving opening with the inclination angle of each bin at the position opposite said sheet receiving opening to be made larger than that at the position for the distribution of the sheets.

Furthermore, each bin is provided with a sheet end regulating member for determining the position the sheet end. The entrance to the sheet transport unit is provided with a sheet guide member so that the end of each sheet on each bin moved to the position opposite said entrance can be guided to the entrance.

That is, in the case of the present invention, each bin shifts its position to the sheet transport unit leading to the binding unit after the sheets have been distributed among the bins and where the inclination of each bin is set larger than that set at the time of the distribution of the sheets so that the delivery and acceptance of the sheet can be made smoothly.

The binding apparatus relating to the present invention has a notch or indent in the part of the binding tray so that the bound parts of the sheets can be accepted into said notch or indent.

BRIEF DESCRIPTION OF THE DRAWINGS

These and other objects and features of the present invention will become apparent from the following description taken in conjunction with the preferred embodiments thereof with reference to the accompanying drawings, in which:

FIG. 1 is a schematic block diagram showing a copying machine and sorter-finisher system;

FIG. 2 is a internal composition of the sorter-finisher system;

FIG. 3 is a vertical cross-sectional view of the sorting unit;

FIG. 4 is a horizontal cross-sectional view of the feed roller section of the sorting unit;

FIG. 5 is a perspective view of the conveyance unit;

FIG. 6 is an explanatory drawing of the floating cam and fixed cam;

FIG. 7 is an explanatory drawing of the floating cam;

FIG. 8 is a perspective view of the sheet takeout position;

FIG. 9 is a plan view showing the mechanical relationship of the trunnion and fixed cam;

FIG. 10 is a vertical cross-sectional view showing the rotary detector of the fixed cam;

FIG. 11 is a plan view of the stapler;

FIG. 12 is an perspective view of the stack tray;

FIG. 13 is a perspective view showing another example of a stack tray;

FIG. 14 is an internal composition view of the sorter-finisher system;

FIG. 15 is a perspective view of a disassembled floating cam section;

FIG. 16 is a plan view showing the mechanical relationship of the trunnion and floating cam; and FIG. 17 is a plan view of the stapler section.

DETAILED DESCRIPTION OF THE PREFERRED EMBODIMENTS

Embodiments of the present invention will be described below with reference to the drawings.

The first embodiment (Composition of whole system)

Figure 1:
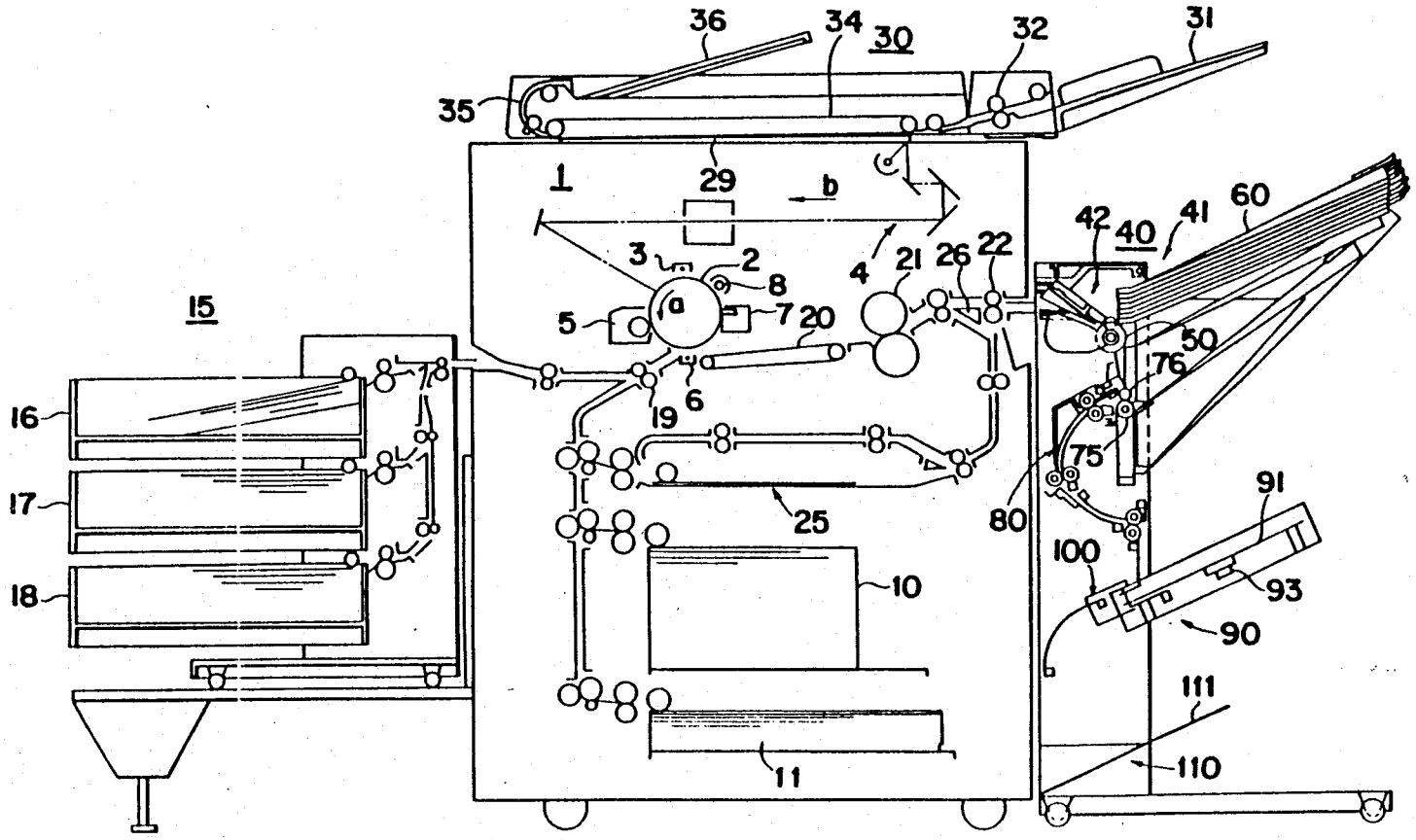
FIG. 1 through FIG. 13 show the first embodiment of the present invention.

A sorter-finisher system 40 relating to the present invention is designed to be installed on the side of copying machine 1 as shown in FIG. 1, and the copying machine 1 is provided with an automatic paper feeding unit 15 and an automatic document feeding unit 30 (hereinafter referred to as ADF).

The copying machine 1 operates on the principle of the commonly known electrophotography. In this copying machine 1, a photosensitive drum 2 to be turned in the direction of an arrow a is charged with a certain amount of static electricity by a static electricity charger 3, and the document set to the specified position by ADF 30 is exposed to the light through a slit when the optical system 40 scans the document in the direction of an arrow b. This causes the electrostatic latent image formed on the photosensitive drum 2 to be developed into the toner image by the magnetic brush type developing device 5 and then transferred onto a sheet by a transfer charger 6.

The sheet are fed one by one selectively from the elevator type and cassette type automatic paper feeders 10 and 11 built in the copying machine 1, or the 3-stage paper feed cassettes 16, 17 and 18 of the automatic paper feeder 15 installed outside the copying machine 1 and are transported to the transferring portion by a timing roller couple 19 with specified timing. The sheet carrying the copied image is delivered to fixing unit 21 by a conveyor belt 20 for fixing the toner image. Then, the sheet is transported to the sorting unit 41 by an ejection roller couple 22 while the passage of the sheet is detected by an ejection switch SW3 (Refer to FIG. 2) provided immediately before the ejection roller couple 22. The copying machine 1 has a built-in paper refeeder 25, which enables duplex copying and composite copy, and a sheet transfer selection click 26 is provided before the ejection roller couple 22.

On the other hand, the photosensitive drum 2 continues to turn in the direction of the arrow a even after the image is transferred so that the residual toner can be removed by a blade-type cleaner 7, and simultaneously the residual electrostatic charge is erased by an eraser lamp 8 in order to prepare for the next copying operation.

The ADF 30 itself is commonly known and designed to feed the documents placed on the document tray 31 one by one using the feed roller couple 32 and is set to the specified position on a glass member 29 of a document rest by the rotary motion of the conveyor belt 34. After the exposure of the image, the document is ejected onto the ejection tray 36 through transfer pass 35 as conveyor belt 34 turns.

Figure 2:
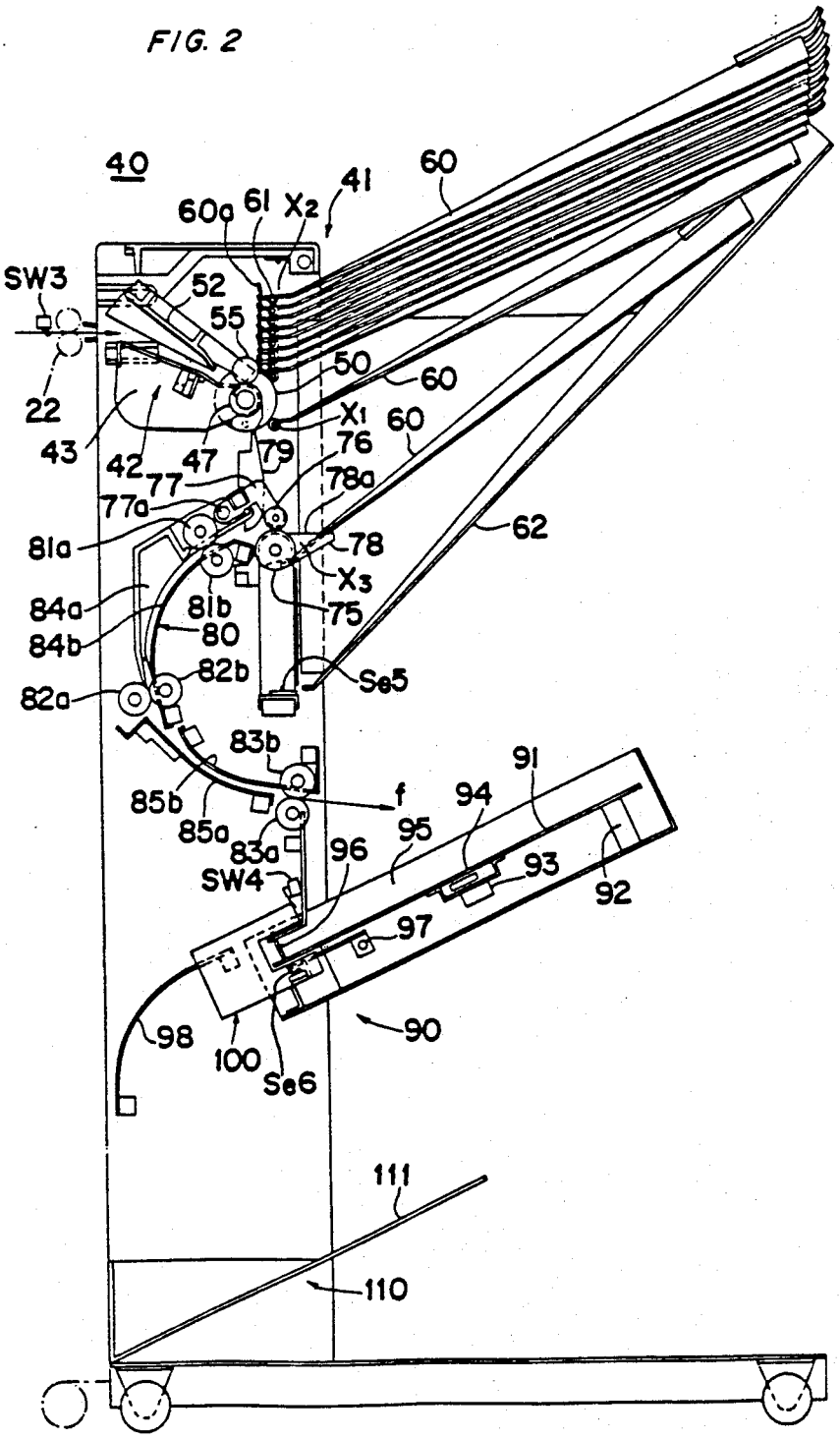

As shown in FIG. 2, the sorter 40 comprises a sorting unit 41 for distributing the sheets among the bins 60, a stapling unit 90 with a stapler 100 for binding the sheets and a stacking unit 110 for stacking the stapled sheets. In this sorter 40, the stapling unit 90 is disposed below the sorting unit 41, and the stacking unit 110 is disposed below the stapling unit 90.

(Composition and operation of the sorting unit)

Figure 3:
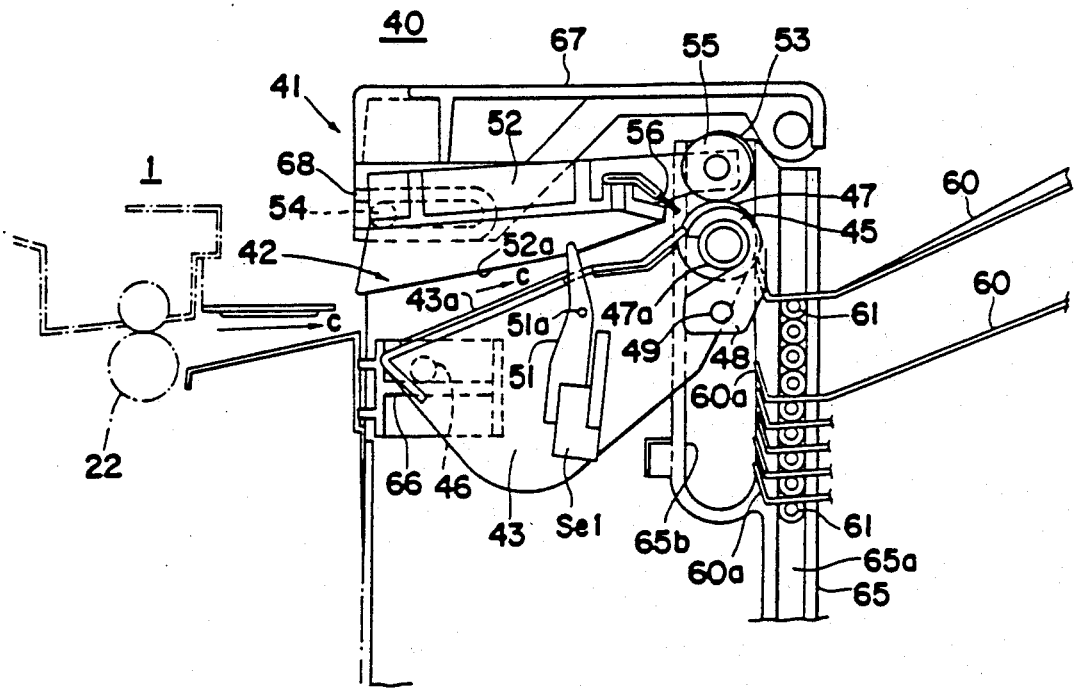
Figure 8:
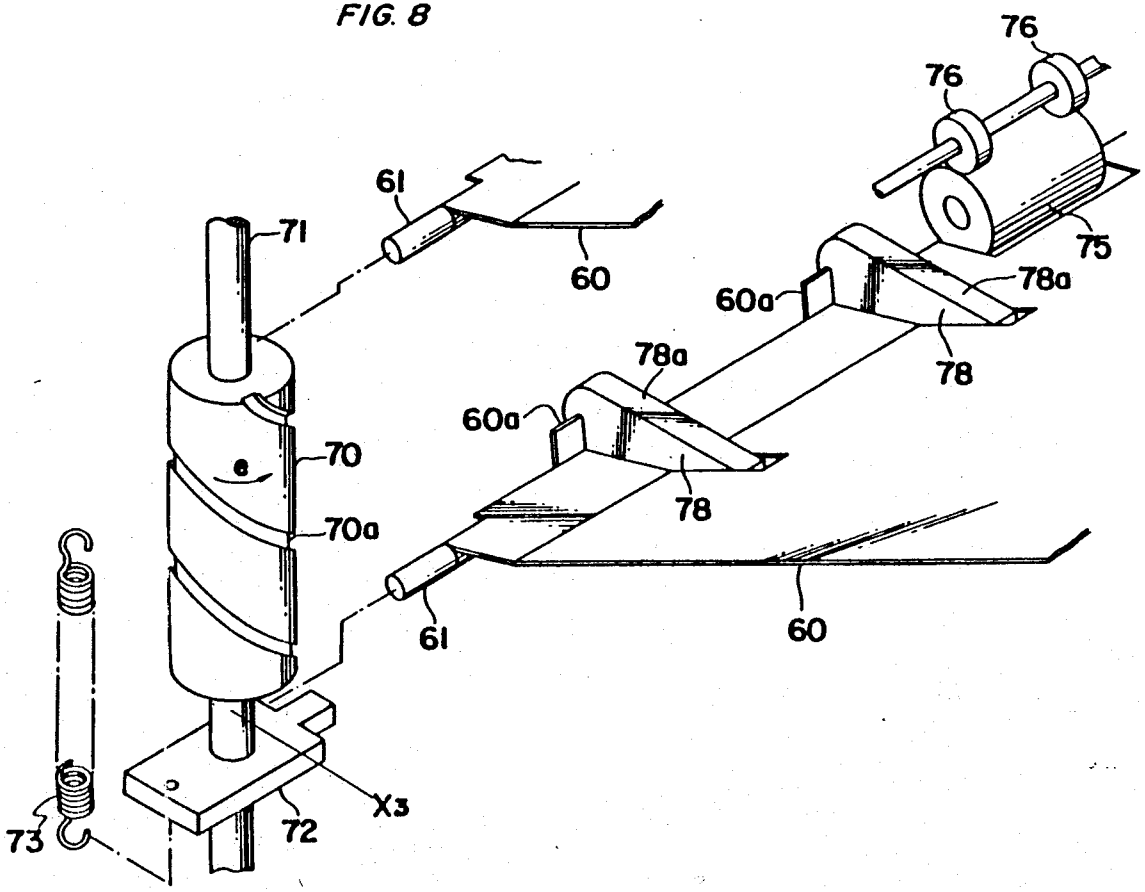
Figure 9:
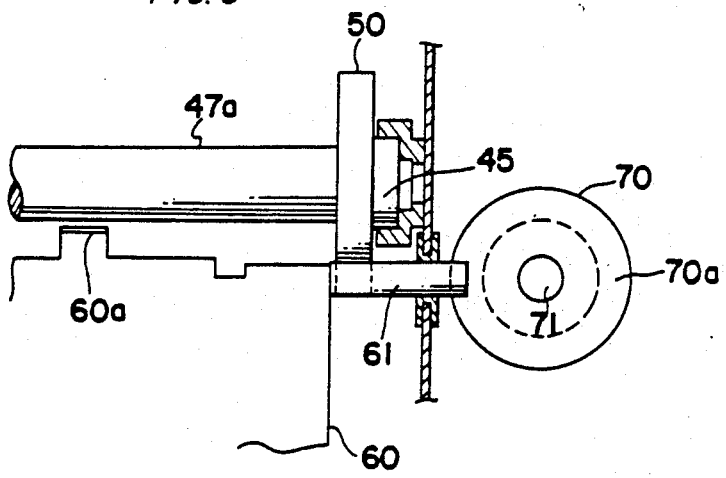

As shown in FIGS. 2, 3 and 8, a plurality of tabs 60*a* for preventing the reverse flow of the sheets and a pair of trunnions 61 are provided on one end of each bin 60. The trunnions 61 engage with a groove 65*a* extending longitudinally along a pair of guide units 65 (only one is shown in FIG. 3) installed on the frame of the sorter 40 in order to regulate the movements of the bins 60 along the longitudinal direction. Another end of each bin 60 is supported by the bin holder 62. A floating cam 50, which will be explained later, shifts the position of the trunnions 61 so that the intervals of the bins 60 can be increased.

The sorting unit 41 distributes the sheets ejected from the copying machine 1 through a relative upward and downward movement between a sheet transport unit 42 disposed opposite the ejection roller couple 22 of the copying machine 1 and bins 60. As shown in FIG. 3, the sheet transport unit 42 comprises an upper unit 52 having a guiding surface 52*a*, a lower unit 43 having a guiding surface 43*a*, a feed roller 47 and a pinch roller 55 so that the sheet from the rollers 47 and 55 is transported to each bin 60 passing between the guiding surfaces 52*a* and 43*a*.

Figure 4:
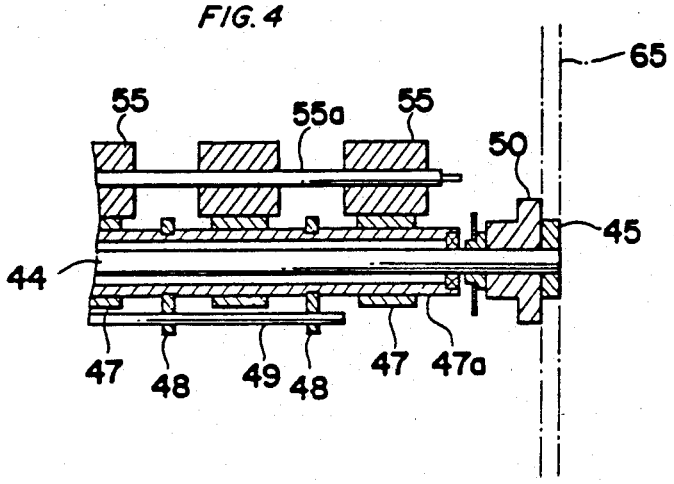
Figure 5:
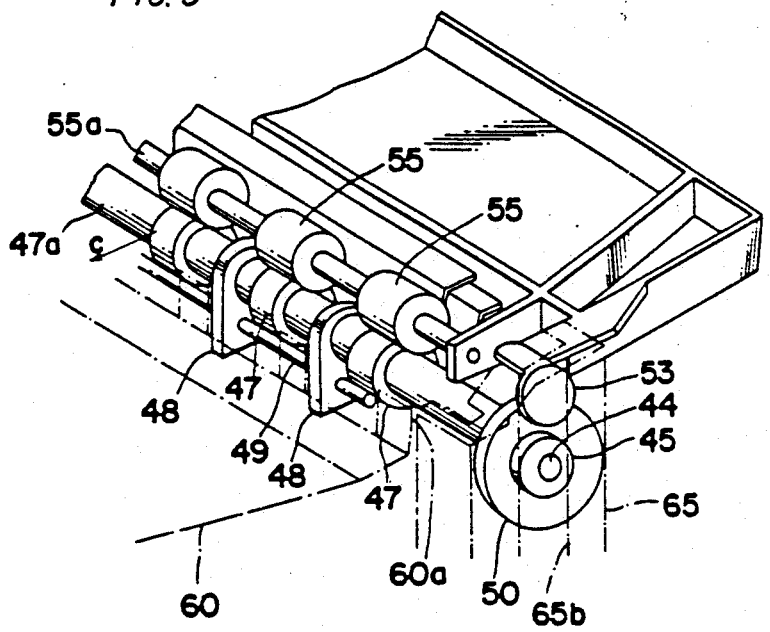

One end of the lower unit 43 is supported movably in upward and downward directions by a supporting shaft 44 disposed on the end of bin 60 orthogonally to the sheet transporting direction indicated by an arrow c. Both ends of the shaft 44 engage with the rail unit 65*b* installed on the guide unit 65 through the collar 45 as shown in FIGS. 4 and 5. Another end of the lower unit 43 has a pin 64 which is supported slidably on a guide member 66.

Figure 6:
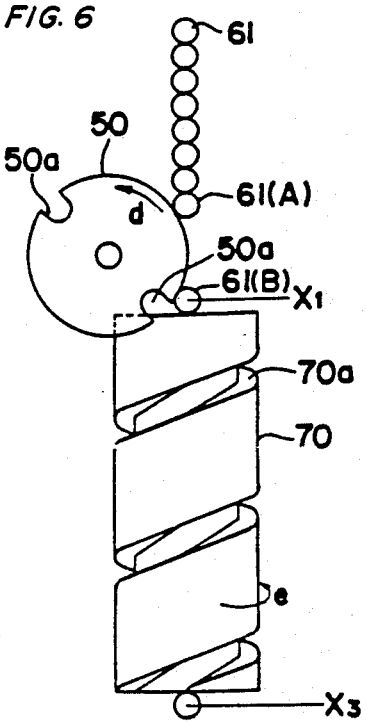
Figure 7:
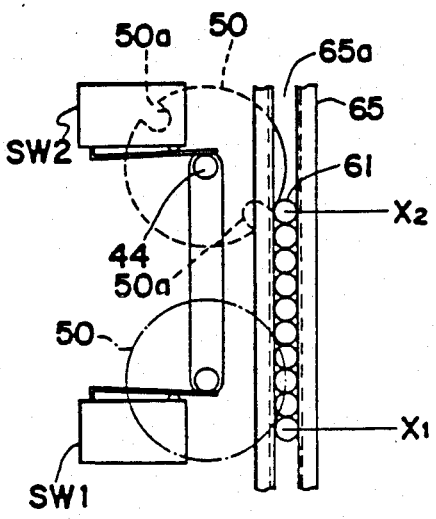

A roller shaft 47*a* upon which a plurality of feed rollers 47 are fixed is installed on said supporting shaft 44 in a manner to permit the free rotation of said roller shaft 47*a*, and oscillating plates 48 are hung from said roller shaft 47*a*. The oscillating plates 48 are connected to each other by a rod 49, and the lower part of the oscillating plates are located between the reverse flow prevention tabs 60*a* of said bins 60. Besides, as shown in FIGS. 6 and 7, floating cams 50, with notches 50*a* and 50*a* formed on the circumferential surface at intervals of 180°, are fixed to both ends of the supporting shaft 44. These floating cams 50 are turned 180° intermittently by the driving source separate from that of the feed roller 47 and support not only the lower unit 43 but also the rear end of bins 60 by means of the trunnions 61 which come to contact their circumferential surface. Furthermore, as shown in FIG. 7, the floating cam 50 can move up and down between a bottom bin position X1 and a top bin position X2, and the cam 50 can be detected by detection switches SW1 and SW2 when it has reached these positions X1 and X2. As shown in FIG. 3, the lower unit 43 is provided with an actuator 51 which turns freely round a pin 51*a* and a photosensor Se1 which can be turned ON and OFF when said actuator 51 turns keeping in contact with the sheet to be transported.

One end of the upper unit 52 has an engaging piece 53 which engages slidably with the rail unit 65*b* thereby oscillating up and down. The other end of the upper unit 52 has a pin 54 which engages slidably with a guide member 68 provided to the top cover 67 of the sorter 40 thereby sliding in horizontal direction. A pinch roller 55 is installed pivotally to said upper unit 52 through the supporting shaft 55*a*. Also, a charge-removing brush 56 is installed to said upper unit 52. The pinch roller 55 pressed against the feed rollers 47 utilizing its own weight, which is capable of being driven by said feed rollers 47.

A transmission type photosensor Se5 (Refer to FIG. 2) whose optical axis is located at the rear end of each bin 60 is installed in said sorting unit 41 so that the presence or absence of the sheets distributed among and in the bins 60 can be detected.

In the above-described composition, the trunnion 61 which is in contact with the circumference of the floating body cam 50, is introduced into the notch 50*a* by every 180° turn in the direction reverse to the direction of the arrow d, thereby not only causing the floating cam 50 to move upward but also causing the introduced trunnion 61 to shift downward to contact the next trunnion 61. Repeating this action causes each bin 60 to shift downward by one step, while the transport unit 42 moves upward. When the sorting mode is selected, the floating cam 50 is located at the bottom bin position X1 as is shown in FIG. 7, and this cam 50 increases the intervals of the bins 60 as it moves upward step by step from this position. The sheets ejected from the copying machine 1 pass between the guiding surfaces 52*a* and 43*a* and between the feed roller 47 and the pinch roller 55 into the bins 60 whose intervals are widened by the floating cam 50. Turning the floating cam 50 towards the normal direction or the direction of the arrow d causes the bins 60 to shift upward one by one, and the cam 50 moves downward together with the transport unit 42.

In the sorting unit 41 having the above-described composition, the sheets can be stored in three different modes. The first mode is the sorting mode to enable the copies of each document to be distributed among the bins 60 and sorted in the order of page numbers. The second mode is the grouping mode to enable the copies of each document to be distributed among the bins 60. The third mode is the non-sorting mode to enable the copies to be stored only in one bin 60.

(Construction and operation of the fixed cam)

Here, the explanation will be made as to the fixed cam 70 and the transport unit 80 which are used for transporting the sheets distributed among the bins 60 to a staple tray 91 which will also be explained in the following.

As shown in FIGS. 6 and 8, the fixed cam 70 has a spiral groove 70*a* formed turning 3 times round the circumferential area of the fixed cam 70 for enabling the engagement of said trunnion 61 and said groove 70*a*, and the fixed cam 70 can be turned both towards the normal direction and reverse direction by a motor not shown in the drawing. That is, the fixed cam 70 turns towards the normal direction or the direction of the arrow e to lower the trunnion 61 of the bins 60, which has been shifted to the bottom bin position X1 by said floating cam 50, to the sheet takeout position X3.

On the other hand, as shown in FIG. 8, at the sheet takeout position X3, a receiving member 72 installed to a supporting shaft 71 is not only movable up and down freely along said supporting shaft 71 but also is urged upward by a coil spring 73, thus the trunnion 61 descended to the takeout position X3 supporting flexibly. Said takeout position X3 is provided with a takeout roller 75, pinch rollers 76 which are pressed against said roller 75 by their own weight and sheet guides 78. Also, as shown in FIG. 2, a sheet reverse flow prevention guide 79 is installed between the bottom bin position X1 and the takeout position X3. As shown in FIG. 8, each sheet guide 78 is installed so that a guiding surface 78*a* on the top of said sheet guide 78 comes a little above the position of the sheet reverse flow prevention tab 60*a* of each bin 60 which has descended to the takeout position X3 by increasing the angle of its inclination. As shown in FIG. 2, the pinch rollers 76 are rotatably supported with a supporting shaft 77*a* through an arm 77 and are kept in contact with or retracted from the roller 75 by a solenoid not shown in the drawing.

Figure 10:
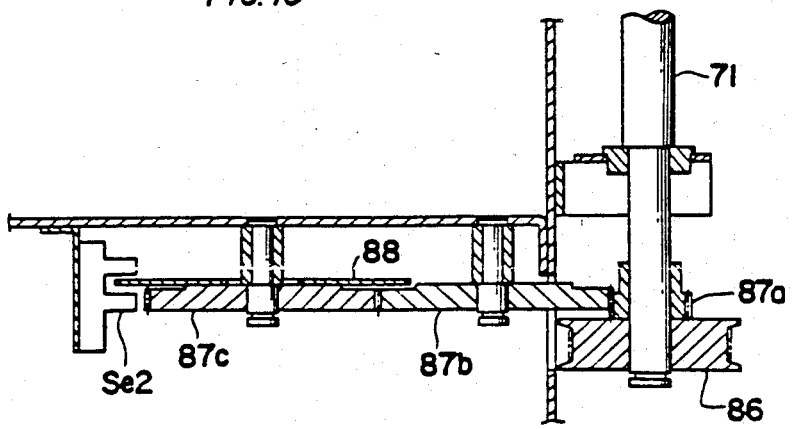

Furthermore, as shown in FIG. 10, a driving pulley 86 and a gear 87*a* are integrally fixed to the lower end of the supporting shaft 71 of said fixed cam 70. The gear 87*a* engages with a gear 87*b* which in turn engages with a gear 87*c*. A disk 88 integrally fixed to the gear 87*c* has notches not shown in the drawings which are detected by a photosensor Se2 in order to control the number of revolutions of the fixed cam 70.

As shown in FIG. 2, the transport unit 80 comprises transport rollers 81*a*, 81*b*–83*a* and 83*b* and guide plates 84*a*, 84*b*, 85*a* and 85*b*. The transport rollers 81*a*, 82*a* and 83*a* are made of rubber material, while the transport rollers 81*b*, 82*b* and 83*b* are made of spongy material so that they are able to transport the various thickness of stacked sheets.

In the above-described arrangement, the fixed cam 70 is turned 3 times in the direction of arrow e after said sorting unit 41 has completed the distribution of the sheets. The trunnion 61 of each bin 60 at the bottom bin position X1 is guided by the spiral groove 70*a* to come down to the takeout position X3 where the trunnion 61 is supported by the receiving member 72. At this takeout position X3, the bin 60 inclines at a larger angle than it does at the bottom bin position X1 so that the sheets distributed and stored slide down on the guiding surface 78*a* of the guide 78 due to their own weight. The takeout roller 75 overlaps with the bin 60 so that the end of the sheets are inserted between the rollers 75 and 76 when the bin 60 has reached the takeout position X3, and the sheets are transported to the transport rollers 81*a* and 81*b* by the rollers 75 and 76. Even when the sheets are curled downward, the sheets can be transported between the guide plates 84*a* and 84*b* without fail guided by the guide 78 and the takeout roller 75. Also, even when the sheets are curled upward, the sheets are transported between the guide plates 84*a* and 84*b* guided by the reverse flow prevention guide 79.

When the sheets are transported by the rollers 81*a* and 81*b*, the solenoid not shown in the drawings is turned off (off is initial state) so that the pinch roller 76 moves upward away from the top of the takeout roller 75. On the other hand, when the bin 60 has reached the takeout position X3, the solenoid is turned on to nip the sheets between the pinch rollers 76 and the takeout rollers 75 and the takeout rollers 75 and the transport rollers 81*a*, 81*b*, 82*a*, 82*b*, 83*a* and 83*b* are driven to turn respectively, and this causes the sheets to be transported onto the staple tray 91 through the transport rollers 83*a* and 83*b* as indicated by an arrow f in FIG. 2.

On the other hand, at the time of sheet takeout operation, the floating cam 50 comes to the position corresponding to the bottom bin position X1 and supports the trunnion 61 immediately before being fed to the fixed cam 70 so that the trunnions 61 can be fed to the fixed cam 70 one by one as said floating cam 50 turns 180° intermittently in the direction reverse to that of an arrow d. In this embodiment, in order to increase the angle of inclination of the bin 60 at the takeout position X3 to facilitate the sheets on the bin 60 sliding downward by their own weight, the interval between the bottom bin position X1 and the takeout position X3, that is, the stroke of the bin 60 that is to move between these two points can be made relatively large. Thus, the torque needed for rotating the fixed cam 70 can be reduced by a small pitch of spiral groove 70*a*. The trunnion 61 is moved from the position X1 to the position X3 by triple rotations of the fixed cam 70 with reduced torque. The trunnion 61(A) immediately before the trunnion 61(B) is supported by the floating cam 50 is fed to the fixed cam 70 so that the trunnion 61(A) can be prevented from being fed to the spiral groove 70*a* at the time of the second or the third turn of the fixed cam 70.

As explained in the foregoing, as the floating cam 50 turns reversely by 180°, and the fixed cam 70 turns 3 times respectively, the bins 60 are brought down step by step to the takeout position X3, and the sheets distributed among the bins 60 are transported onto the staple tray 91 by the transport unit 80.

Each bin 60 brought down to the takeout position X3 is supported by the receiving member 72. And the bin 60 returns to its upward original position by the rotation of the fixed cam 70 in the direction reverse to the arrow e, and the floating cam 50 towards its normal direction or the direction of the arrow d after all the sheets distributed among the bins 60 are taken out.

(Construction and operation of the stapling unit)

As shown in FIG. 2, the stapling unit 90 comprises the staple tray 91, a motor to vibrate the staple tray 91, a guide plate 95, a stopper 96 and a stapler 100. The staple tray 91 is oscillatably installed on the supporting shaft 92 to serve as a supporting point, and the staple tray 91 vibrates by the centrifugal force of an eccentric weight 94 turned by the motor 93. This vibration causes the sheets which have been transported from said transport unit 80 to be trued up while they are regulated by the stopper 96.

Figure 11:
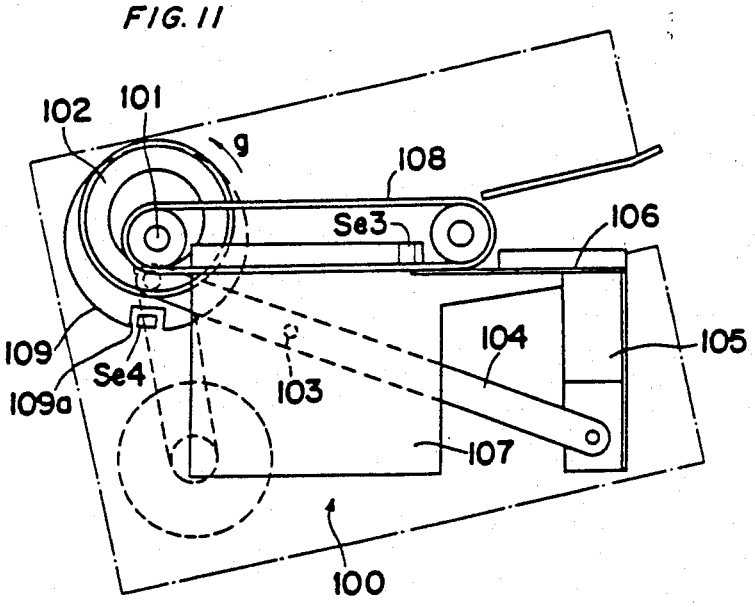

As shown in FIG. 11, the stapler 100 comprises a fixed output shaft 101 of a motor, an oscillating arm 104 on a pin 103 to serve as a supporting point and a cam 102 whose circumferential part is connected to a head 105 so that the rotation of the cam 102 in the direction of an arrow g by the motor causes the head 105 to move upward through the arm 104, and a staple 106 binds the sheets trued up on the tray 91. The staples 106 are contained in a cartridge 107 and transported to the head 105 by the conveyor belt 108 which is driven to turn by said output shaft 101 of the motor.

The stopper 96 is installed on the supporting shaft 97 to serve as a supporting point so that the stopper 96 can be turned by a solenoid not shown in the drawings. The stopper 96 is normally located on the lower end of the staple tray 91 to determine the end position of the sheets. When the solenoid is turned on, the stopper 96 retreats downwards to cancel the sheet positioning.

The stapler 100 is provided with a photosensor Se3 for detecting the absence of the staples 106 and a sensor Se4 for detecting the number of revolutions of the staple motor so that the sensor Se3 directly detects the staples 106, while the sensor Se4 detects the notch 109*a* of a disk 109 fixed to the output shaft 101 of the motor.

Furthermore, the stapling unit 90 is provided with a photosensor Se6 for detecting the presence and absence of the sheet on the staple tray 91 and a switch SW4 for detecting the mounting and dismounting of the stapler 100.

In the above-described arrangement, the sheets transported onto the staple tray 91 from said transport unit 80 are trued up by the guide plate 95 and the stopper 96 as the tray 91 is vibrated by the rotation of the motor 93. The trued up sheets are bound by the staple motor. When the solenoid is turned on to withdraw the stopper 96 from the tray 91, the bound sheets slide down onto the stack tray 111 by being guided by the plate 98. Such stapling operation is repeated each time sheets in the bins 60 are carried onto the staple tray 91.

The absence of the staples 106 is not necessarily required to be detected only by the sensor Se3. That is, at the time of the stapling operation, the absence of the staples 106 can also be detected by said sensor Se4, since the number of revolutions of the staple motor increases when the torque needed for rotating the cam 102 has decreased due to the absence of the staples 106. Thus, the increase in the number of revolutions of the staple motor indicates the absence of the staples 106.

(Construction of the stack unit)

Figure 12:
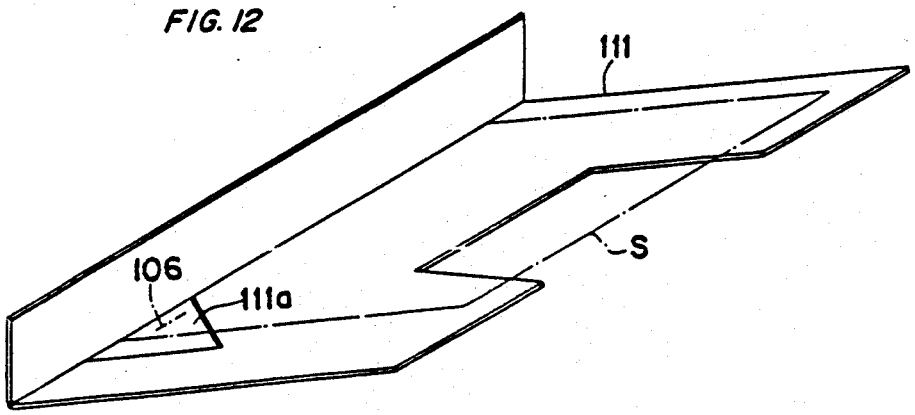

The stack unit 110 comprises the stack tray 111 which is designed for finally containing the sheets bound by said stapler 100. As shown in FIG. 12, the stack tray 111 has a notch 111*a* in its part to be used for the stapling of the sheets S, that is, the part of the sheet stapled with the staple 106 is located so that the sheet bound with the stapler 100 and placed on the tray 111 hangs down into the notch 111*a* by its own weight, whereby not only the stapled parts of bound sheets can be prevented from becoming higher than the non-stapled parts when they are stacked but also the stacking capacity of the tray 111 can be increased.

Figure 13:
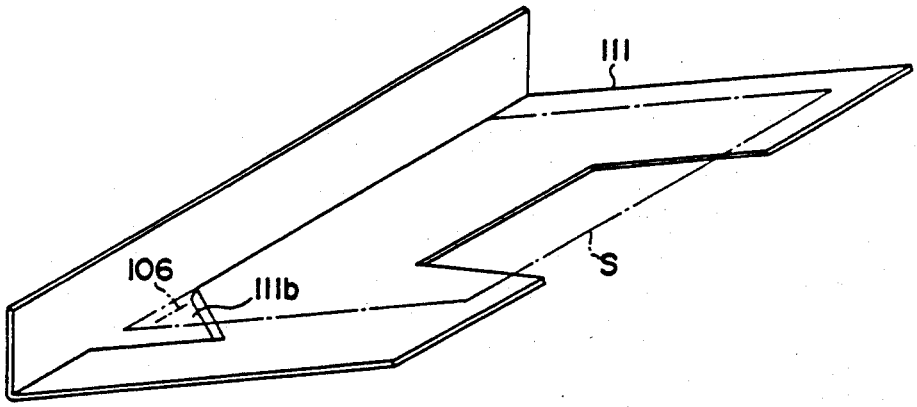
Figure 14:
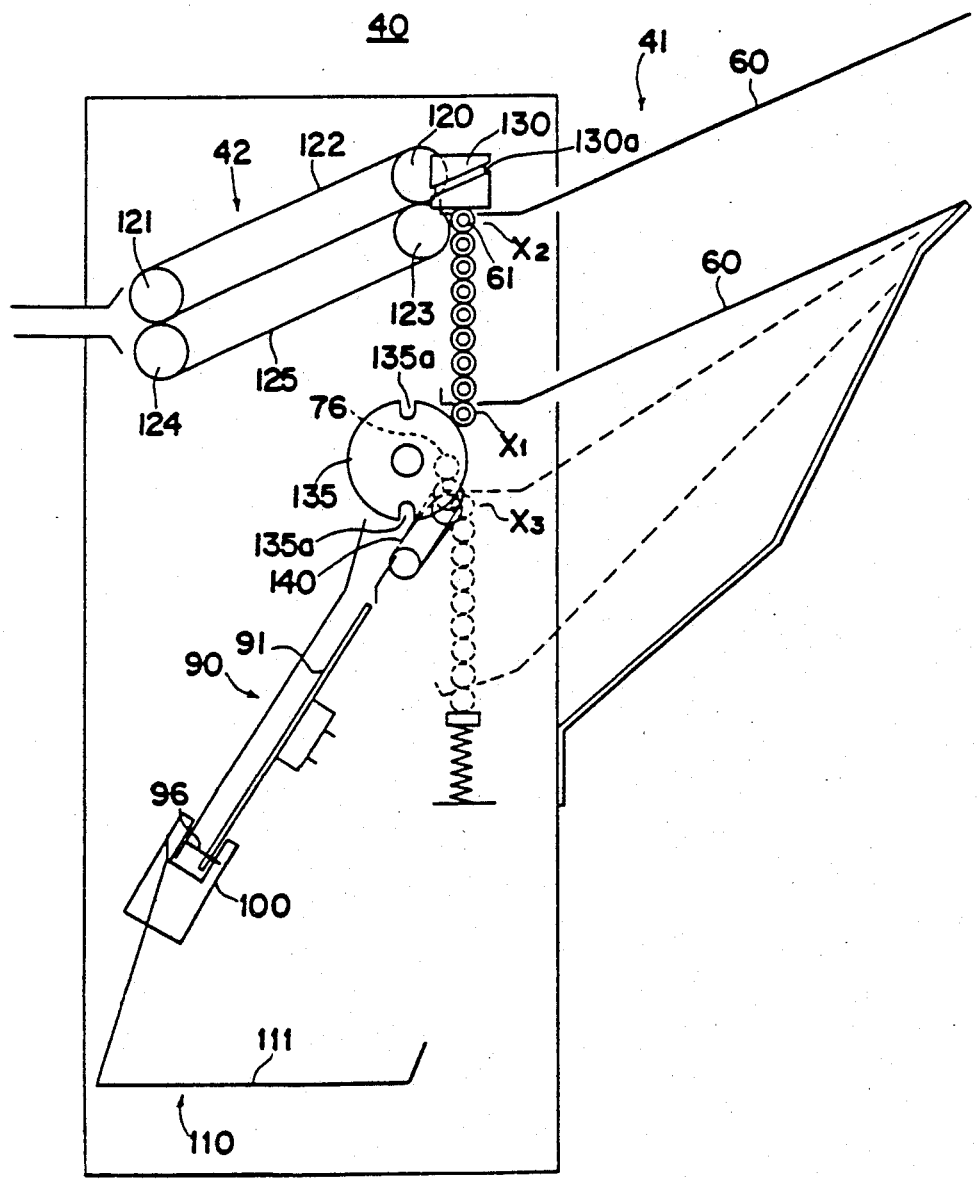
FIG. 14 through FIG. 17 show the second embodiment of the present invention.
Figure 15:
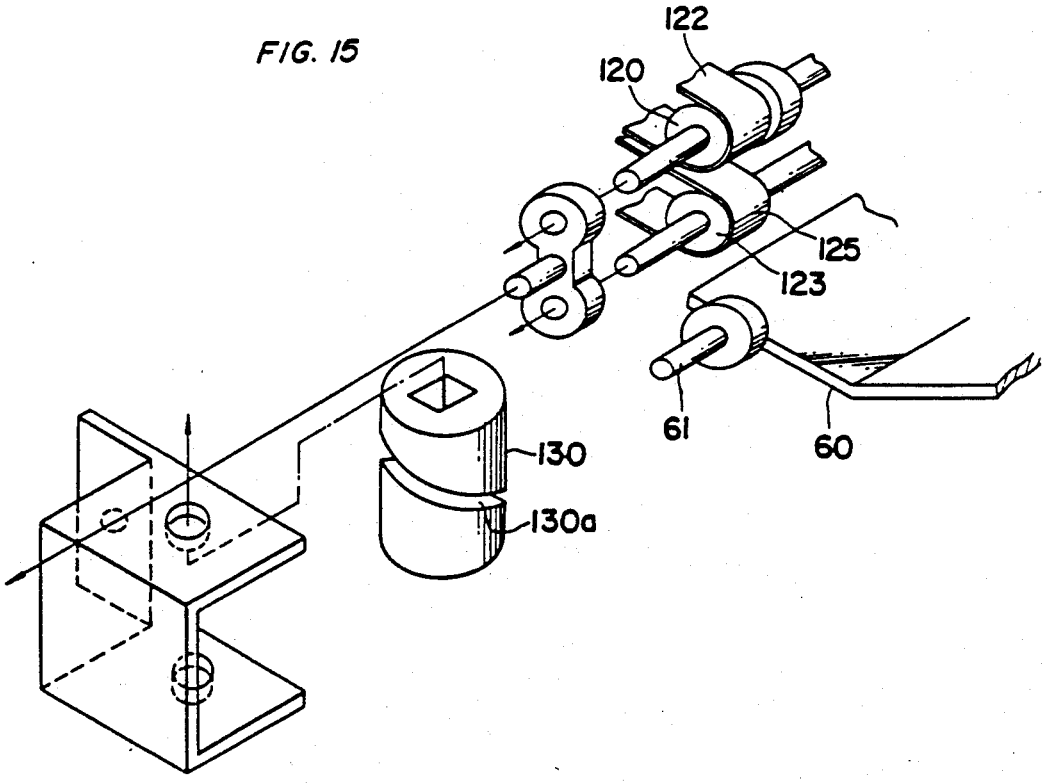

The similar effect can also be achieved when an indent 111*b* is formed in the part of the stack tray 111 where the parts of the sheets bound with staples 106 are stacked as shown in FIG. 13.

The second embodiment

The second embodiment of the present invention will be explained in reference to FIGS. 14 through 17.

Figure 16:
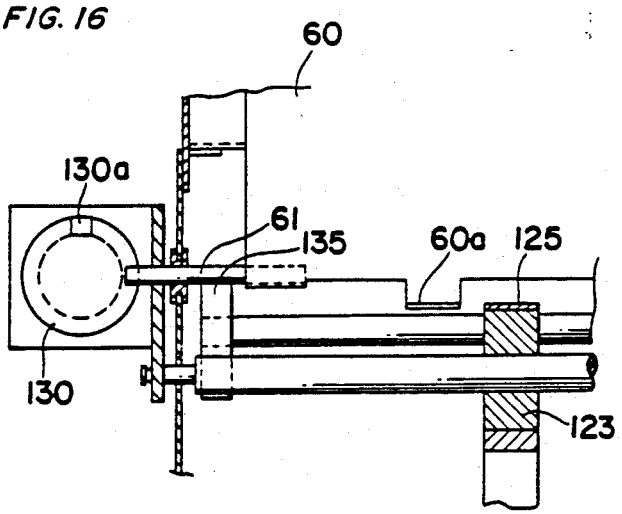
Figure 17:
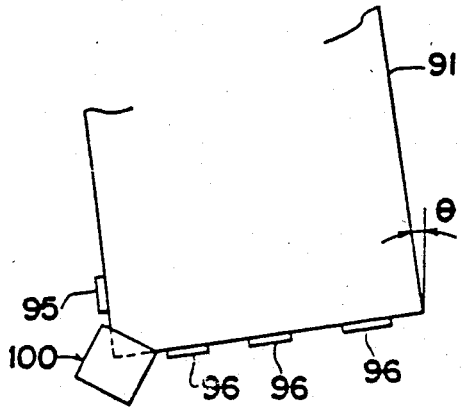

The second embodiment is basically the same as the first embodiment. That is, the sorting unit 41, stapling unit 90 and stack unit 110 are arranged vertically. The transfer unit 42 of the sorting unit 41 comprises belts 122 and 125 which are laid spanning drive rollers 120 and 123 and driven rollers 121 and 124. A cam with a spiral groove 130*a* formed around its circumferential area is used for a floating cam 130 to let said transfer unit 42 and the bins 60 relatively move upward and downward. For a fixed cam 135 to let the bins 60 descend respectively from the bottom bin position X1 to the sheet takeout position X3, a Geneva cam with two notches 135*a* and 135*a* provided on its circumferential area is used. For taking out the sheets at the takeout position X3, a belt conveyor 140 is used. With this belt conveyor 140, the sheets are directly transferred onto the tray 91 of the stapling unit 90 without being reversed through the transport unit 80 as is the case in the first embodiment. As shown in FIG. 16, said staple tray 91 is installed so that it is inclined in the direction of the width at an angle of $\theta$.

The rest of the arrangement of this second embodiment is similar to that of the first embodiment. Thus, the members common to the first embodiment carry the same numbers as those in the case of the first embodiment, and the explanations concerning these members are omitted here.

In this second embodiment, not only the intervals of the bins 60 are increased one by one as the trunnions 61, which engage with the spiral groove 130*a* each time when the cam 130 makes a round of turn, moves up and down but also the transport unit 42 moves up and down to distribute the sheets among the bins 60. The bins 60 containing the distributed sheets are supported with the trunnions 61 which contact the circumferential part of the cam 135 and brought down to the takeout position X3 as the cam 135 turns by 180° each time. In this arrangement, the sheets are dropped onto the staple tray 91 by the belt conveyor 140 and bound by the stapler 100. The bound sheets are stacked on the stack tray 111 by the withdrawing action of the stopper 96.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A sorter-finisher for sorting and binding sheets, comprising:

a plurality of bins with inclined sheet loading surfaces arranged vertically at specified intervals;

means for distributing sheets among said plurality of bins;

means located adjacent the plurality of bins for binding the sheets from each bin;

means, having a sheet receiving opening located below said plurality of bins, for receiving the sheets through said receiving opening and for transporting the sheets to said binding means; and means for shifting said plurality of bins one by one to a position opposite said sheet receiving opening with an inclination angle of each bin at the position opposite said sheet receiving opening being larger than that at the position for the distribution of the sheets.

2. The sorter-finisher defined in claim 1, further comprising a sheet-end positioning regulating member designed for determining the end-position of the sheet loaded on the sheet loading surface and a sheet guiding member installed near said sheet receiving opening for guiding the end of sheet on each bin moved to the position opposite said sheet receiving opening.

3. The sorter-finisher defined in claim 1, wherein the sheet distributing means comprises a means for widening the intervals of the bins and means for feeding the sheets to the bins whose intervals are widened.

4. The sorter-finisher defined in claim 1, wherein the shifting means comprises a cam with a spiral groove to engage with trunnions provided to each of the bin.

5. The sorter-finisher defined in claim 1, wherein the binding means comprises an inclined sheet loading member, a sheet-end regulating member installed at an end of said sheet loading member so as to be able to move both forward and backward freely, means for truing up the sheets loaded on the sheet loading member and a stapler constituting a part of a stapling unit.

6. The sorter-finisher defined in claim 1, wherein the binding means comprises:

a stapling device for stapling one corner of a group of sheets on a staple tray, and for taking out the stapled group of sheets from the staple tray; and a stack tray and stacking device for stacking a plurality of taken-out group of sheets on the stack tray, said stack tray being formed with an opening in a part thereof so that the stapled part of the group of sheets can be accepted into said opening when the plurality of stapled groups of sheets are stacked on said stack tray.

7. A sorter-finisher apparatus for sorting and binding sheets, comprising:

a sorting device including a plurality of bins each of said bins having an inclined sheet containing surface and a sheet end regulating member having a specified height installed at the end of the bin for containing the sheets thereon, said sorting device further including a distributor for distributing the sheets among said plurality of bins, said bins arranged vertically at specified intervals and at least one end of said bins being movable in a vertical direction, said inclined sheet containing surface including an opening through which the sheets on the surface are accessible;

a binding device for binding each bunch of sheets, said binding device being disposed under said sorting device;

a sheet transport device, disposed between said sorting device and said binding device, having a sheet receiving inlet for receiving bunches of sheets distributed among said bins and a transport mechanism for transporting the receiving sheets to said binding device;

a shift mechanism for shifting said plurality of bins one by one to the position opposite said sheet receiving inlet;

a shift guiding member provided near said sheet receiving inlet for moving upwardly through said opening and guiding the end of sheets on each bin, which has reached the position opposite said sheet receiving inlet, into said sheet receiving inlet beyond said sheet-end regulating member; and a stacking device, disposed under the binding device, for stacking the sheets bound by said binding device.

8. The sorter-finisher apparatus defined in claim 7, wherein the binding device comprises:

a stapling device for stapling one corner of a group of sheets on a staple tray, and for taking out the stapled group of sheets from the staple tray; and a stack tray and a stacking device for stacking a plurality of taken-out groups of sheets on the stack tray, said stack tray being formed with an indent in a part thereof so that the stapled part of the group of sheets can be accepted into said indent when the plurality of stapled groups of sheets are stacked on said stack tray.

9. A binding apparatus, comprising:

a stapling device for stapling one corner of a group of sheets on a staple tray, and for taking out the stapled group of sheets from the staple tray; and a stack tray and a stacking device for stacking a plurality of taken-out groups of sheets on the stack tray, said stack tray being formed with an opening in a part thereof so that the stapled part of the group of sheets can be accepted into said opening when the plurality of stapled groups of sheets are stacked on said stack tray.

10. A binding apparatus, comprising:

a stapling device for stapling one corner of a group of sheets on a staple tray, and for taking out the stapled group of sheets from the staple tray; and a stacking tray and a stacking device for stacking a plurality of taken-out groups of sheets on the stack tray, said stack tray being formed with an indent in a part thereof so that the stapled part of the group of sheets can be accepted into said indent when the plurality of stapled groups of sheets are stacked on said stack tray.

11. A sorter-finisher apparatus for sorting and binding sheets, comprising:

a sorting device including a plurality of bins, each of said bins having an inclined sheet loading surface, said bins being arranged vertically at specified intervals so that at least one end thereof is able to move in a vertical direction independently from each other, a moving mechanism for widening the interval between the bin into which a sheet is to be fed and the bin next to said bin, and a feeder for feeding the sheets to the bins whose intervals are widened;

a binding device located adjacent the plurality of bins for binding the sheets from each bin, said binding device being disposed under said sorting device;

a sheet transport device, disposed between said sorting device and said binding device, said sheet transport device having a sheet receiving opening, a take-out mechanism for taking out the bunches of sheets distributed among the bins and a transport mechanism for transporting the sheets taken-out to said binding device;

a shift mechanism, disposed between said sorting device and said transport device, for determining a lower-limit position of the lowest bin and for shifting said plurality of bins one by one to the position opposite said sheet receiving opening with the inclination angle of each bin at the position opposite said sheet receiving opening being made larger than that at the position above said lower-limit position, said shift mechanism including a cam which is designated to turn at a fixed position in order to enable the bins to be shifted to the take-out position one by one starting from the bin at the lowest position and independently from each other; and a stacking device, disposed under the binding device, for stacking the sheets bound by said binding device.

12. The sorter-finisher apparatus defined in claim 11, wherein said regulating means is a cam with a spiral groove provided on the circumferential part of said cam.

13. A sorter-finisher for sorting and binding sheets, comprising:

a plurality of bins with inclined sheet loading surfaces arranged vertically at specified intervals;

means for distributing sheets among said plurality of bins;

means located adjacent the plurality of bins for binding the sheets from each bin;

means, having a sheet receiving opening located below said plurality of bins, for receiving the sheets through said receiving opening and for transporting the sheets to said binding means; and means for shifting said plurality of bins one by one to a position opposite said sheet receiving opening with an inclination angle of each bin at the position opposite said sheet receiving opening being larger than that at the position for the distribution of the sheets;

wherein the binding means includes:

a stapling device for stapling one corner of a group of sheets on a staple tray, and for taking out the stapled group of sheets from the staple tray; and a stack tray and a stacking device for stacking a plurality of taken-out groups of sheets on the stack tray, said stack tray being formed with an indent in a part thereof so that the stapled part of the group of sheets can be accepted into said indent when the plurality of stapled groups of sheets are stacked on said stack tray.

14. A sorter-finisher apparatus for sorting and binding sheets comprising:

a sorting device including a plurality of bins, each of said bins having an inclined sheet containing surface and a sheet end regulating member having a specified height installed at the end of the bin for containing the sheets thereon, said sorting device further including a distributor for distributing the sheets among said plurality of bins, said bins arranged vertically at specified intervals and at least one end of said bins being movable in a vertical direction, said inclined sheet containing surface including an opening through which the sheets on the surface are accessible;

a binding device for binding each bunch of sheets, said binding device being disposed under said sorting device;

a sheet transport device, disposed between said sorting device and said binding device, having a sheet receiving inlet for receiving bunches of sheets distributed among said bins and a transport mechanism for transporting the receiving sheets to said binding device;

a shift mechanism for shifting said plurality of bins one by one to the position opposite said sheet receiving inlet;

a sheet guiding member provided near said sheet receiving inlet for moving upwardly through said opening and guiding the end of sheets one each bin, which has reached the position opposite said sheet receiving inlet, into said sheet receiving inlet beyond said sheet-end regulating member; and a stacking device, disposed under the binding device, for stacking the sheets bound by said binding device wherein the binding device;

wherein the binding device includes:

a stapling device for stapling one corner of a group of sheets on a staple tray, and for taking out the stapled group of sheets from the staple tray; and a stack tray and a stacking device for stacking a plurality of taken-out groups of sheets on the stack tray, said stack tray being formed with an opening in a part thereof so that the stapled part of the group of sheets can be accepted into said opening when the plurality of stapled groups of sheets are stacked on said stack tray.

* * * * *